US010925786B2

(12) United States Patent
Ueda

(10) Patent No.: US 10,925,786 B2
(45) Date of Patent: Feb. 23, 2021

(54) DEVICE TO PROVIDE ASSISTANCE IN TRANSFERRING, STANDING, AND THE LIKE

(71) Applicant: ENERGYFRONT INC, Okayama (JP)

(72) Inventor: Takeji Ueda, Okayama (JP)

(73) Assignee: ENERGYFRONT INC, Okayama (JP)

( * ) Notice: Subject to any disclaimer, the term of this patent is extended or adjusted under 35 U.S.C. 154(b) by 87 days.

(21) Appl. No.: 16/332,768

(22) PCT Filed: Oct. 26, 2016

(86) PCT No.: PCT/JP2016/081724
§ 371 (c)(1),
(2) Date: Mar. 12, 2019

(87) PCT Pub. No.: WO2018/055779
PCT Pub. Date: Mar. 29, 2018

(65) Prior Publication Data

US 2019/0358102 A1 Nov. 28, 2019

(30) Foreign Application Priority Data

Sep. 23, 2016 (JP) ..... JP2016-185259

(51) Int. Cl.
*A61G 5/14* (2006.01)
*A61G 5/12* (2006.01)
(Continued)

(52) U.S. Cl.
CPC ..... *A61G 5/14* (2013.01); *A41F 9/002* (2013.01); *A61G 5/1091* (2016.11); *A61G 5/124* (2016.11); *A61G 5/127* (2016.11)

(58) Field of Classification Search
CPC ..... A61G 5/14; A61G 5/124; A61G 5/127; A61G 5/1091; A61G 7/1096; A61G 7/1023; A41F 9/002; A41F 9/00
(Continued)

(56) References Cited

U.S. PATENT DOCUMENTS 3,967,329 A * 7/1976 Whitton, Jr. ..... A61G 7/1038 5/81.1 R
4,782,539 A * 11/1988 Elliott ..... A61G 1/01 224/159
(Continued)

FOREIGN PATENT DOCUMENTS

JP 2001899214 B 10/2001
JP 200513304 A 1/2005
(Continued)

OTHER PUBLICATIONS

Japan Patent Office, International Search Report, dated Feb. 2, 2017, 7 pages, Japanese International Searching Authority, Japan.

*Primary Examiner* — Peter M. Cuomo
*Assistant Examiner* — Myles A Throop
(74) *Attorney, Agent, or Firm* — Ashkan Najafi

(57) ABSTRACT

A device to provide assistance in transferring and standing includes a knee-fixing unit wrapped around and supporting either the knee area or at least the front and sides of the lower leg area from knee to ankle of a care-receiver; a pelvis support wrapped around at least the buttocks or a section from the pelvis to thighs of said care-receiver in a manner that prevents slippage from said pelvis support from slipping off; and left and right pulling bands. Each band having two connecting ends attached to the side of a thigh section and the side of a hip section of said pelvis support respectively so that said bands are positioned above and below the greater trochanter when said care-receiver is being pulled up during
(Continued)

transfer/standing assistance and are positioned in front of and behind the greater trochanter when said care-receiver is seated.

6 Claims, 4 Drawing Sheets

(51) Int. Cl.
*A61G 5/10* (2006.01)
*A41F 9/00* (2006.01)

(58) Field of Classification Search
USPC ..... 5/81.1 R
See application file for complete search history.

(56) References Cited

U.S. PATENT DOCUMENTS 4,829,612 A * 5/1989 Adams ..... A61G 7/1038 297/DIG. 10
5,076,288 A * 12/1991 Millard ..... A61F 5/3776 128/869
6,108,819 A * 8/2000 DeBaene ..... A41D 1/067 2/227
6,276,006 B1 * 8/2001 Hoit ..... A61G 7/1023 5/81.1 R
7,334,275 B1 * 2/2008 Kirkwood ..... A61F 5/3715 128/876
7,476,185 B2 * 1/2009 Drennan ..... A61F 5/0193 482/121
7,594,281 B1 * 9/2009 Stinson ..... A41D 13/0007 2/310
7,627,911 B1 * 12/2009 Traykov ..... A61G 7/1096 5/81.1 R
7,627,912 B1 * 12/2009 McKinney ..... A61G 7/1011 5/81.1 R
9,687,033 B2 * 6/2017 Lillie ..... A41D 13/1254
2002/0026667 A1 * 3/2002 Berry ..... A61G 7/1023 5/83.1
2003/0172431 A1 * 9/2003 Allen ..... A41D 13/0007 2/69
2003/0195445 A1 * 10/2003 Behan ..... A61F 5/012 602/19
2008/0189853 A1 * 8/2008 Felling ..... A61G 7/1023 5/89.1
2009/0315385 A1 * 12/2009 Shickle ..... A61F 5/3776 297/468
2010/0285938 A1 * 11/2010 Latronica ..... A63B 21/16 482/124
2012/0085795 A1 * 4/2012 Peng ..... A61G 7/1023 224/159
2013/0270881 A1 * 10/2013 Fowler ..... A61G 5/12 297/219.1
2013/0319793 A1 * 12/2013 Stibilj ..... A62B 35/0012 182/3
2014/0207040 A1 * 7/2014 Ingimundarson ..... A61F 5/0193 602/23
2015/0021118 A1 * 1/2015 Doty ..... A62B 35/0025 182/3
2016/0367429 A1 * 12/2016 Dolce ..... A61H 3/008
2017/0128299 A1 * 5/2017 Tsusaka ..... A61G 5/14
2017/0216635 A1 * 8/2017 Stibilj ..... A62B 35/0025
2019/0030708 A1 * 1/2019 Holgate ..... A61H 1/00

FOREIGN PATENT DOCUMENTS

JP 3668808 B 7/2005
JP 3957661 B 8/2007
JP 6089176 B 3/2017
JP 2019056183 A * 4/2019
WO 2018055779 B 3/2018

* cited by examiner

DEVICE TO PROVIDE ASSISTANCE IN TRANSFERRING, STANDING, AND THE LIKE

CROSS REFERENCE TO RELATED APPLICATIONS

This application is a U.S. National Phase entry of Patent Cooperation Treaty application no. PCT/JP2016/081724, filed on Oct. 26, 2016, currently pending, which claims priority to and the benefit of Japanese patent application no. 2016-185259, filed Sep. 23, 2016, which was issued as Japanese patent no. 715005239 on Mar. 8, 2017.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND

Technical Field

The present invention is a stand aid used when transferring an elderly person or disabled person from a bed to a wheelchair or transferring them to a lift or chair, etc., which causes a seated care-receiver to stand and leads them to and seats them in a place to which they are to be transferred.

Prior Art

Stand-assist devices are commonly used for a care-receiver with difficulty standing to stand up, or when transferring them to a wheelchair, and transferring them to a lift or chair, etc. Depending on the care-receiver's physical condition, such devices as lifting hoists supporting the entire weight of a care-receiver, stand-assist devices attached to a wheelchair, standing assist seats using springs, pulling bands for a caregiver to pull on (disclosed in Patent Document 1 and Patent Document 2), garments for caregiving (Patent Document 3), and a leg-fixing stand-up apparatus (Patent Document 4) have been disclosed.

Patent Document 1: (PCT-A) No. JP-T-2004-514503. Patent Document 2: Japanese Utility Model (JP-U) No. 3155229. Patent Document 3: JP-A No. Hei 11-81010. Patent Document 4: JP-A No. 2004-41631. See also the international search report listed in Applicant's Information Disclosure Statement.

Among these, pulling bands, garments for caregiving, and leg-fixing stand-up apparatuses have an advantage in applicability in various situations because of their light weight and portability, as well as lower price compared to others.

In the case of the pulling bands disclosed in Patent Document 1, a caregiver puts a waistband on a seated care-receiver, and then pulls up the care-receiver by pulling the pulling band in combination with the waistband in the diagonally upward direction, leading the care-receiver to standing position.

In the case of pulling bands disclosed in Patent Document 2, a pulling band includes an assist band main body consisting of a low-back support-band and a buttocks support-band, instead of a waistband as in Patent Document 1. A caregiver leads the care-receiver to a standing position by pulling the pulling bands connected to the assist band main body diagonally upward.

In the case of the garments for a caregiver and for a care-receiver disclosed in Patent Document 3, band-style grasping parts are attached on the caregiver's aprons as well as on the care-receiver's pants in order to facilitate standing assistance.

In the case of the leg-fixing stand-up assist device disclosed in Patent Document 4, a knee-brace-like device, by linking the knees of a care-receiver with the knees of a caregiver, facilitates standing assistance of a care-receiver with poor leg strength by preventing them from bending at the knees as a result of being unable to support their own bodyweight.

Though the method disclosed in above-mentioned Patent Document 1 is beneficial in that a caregiver can pull up a care-receiver grasping the pulling bands, there is a heavy burden on the caregiver having to lift a care-receiver up in order for them to wear the device. Furthermore, because of the narrow supporting area of the bands, care-receivers may face risk of fracture by concentrated pressure, particularly with older persons with less bone strength, as well as the problem of the care-receiver being prone to instability during the pulling-up motion.

The devices in Patent Document 2 were invented to eliminate those problems and contribute to relatively easier suiting-up of care-receivers without mistaking the direction and stabilizing the pulling-up motion, but do not eliminate the troublesome nature of suiting-up work, and the device remains as a special tool requiring expertise. Experienced caregivers who routinely assist care-receivers with their bodies only, may not necessarily feel the device contribute to the reduction of work.

The method disclosed in Patent Document 3 was invented so as to be worn at all times by attaching handles on caregivers' clothing and aprons as well as on the hip area and back area of pants worn by care-receivers. A caregiver grasps the lower back area handle of the care-receiver with one hand and grasps the hip area handle with the other hand. Though this method has the advantage of saving time and effort in suiting-up, the method of pulling up the care-receiver from the lower back side has the drawback of causing pain or psychological distress by pressure from the garment on the groin of the care-receiver and is not necessarily a preferable method.

The device disclosed in Patent Document 4 was invented to enable transfer assistance of care-receivers for who have difficulty supporting their bodyweight on their knees and maintain a standing position. The device consists of knee-brace-like pads for both legs and a plate connecting them. A caregiver prevents the care-receiver from crouching forward during transfer assistance by fixing the care-receiver's knees and by pressing his/her knee against the care-receiver's knees. This invention is successful in partially compensating for the drawbacks of the pulling bands and garments, but the device has less structural flexibility requiring precise adjustment to meet the care-receiver's leg size to avoid slipping out or over-tightening. In other words, the invention lacks versatility for care-receivers with different leg thicknesses, such as those wearing knee supporters, and a weakly attached device has the risk of falling off especially in slippery conditions like during shower assistance.

This purpose of the invention, therefore, is to provide a device to provide assistance in transferring, standing, and the like solving the above-mentioned problem of troublesome suiting-up. In other words, the device enables stand-assist at any time by being designed as cushions, garments, and supporters that care-receivers can wear on a daily basis and facilitate care of care-receivers who cannot maintain a standing position integrating by the knee-fixing function.

BRIEF SUMMARY OF NON-LIMITING EXEMPLARY EMBODIMENT(S) OF THE PRESENT DISCLOSURE

In view of the foregoing background, it is therefore an object of the non-limiting exemplary embodiment(s) to provide a stand aid used when transferring an elderly person or disabled person from a bed to a wheelchair or transferring them to a lift or chair, etc., which causes a seated care-receiver to stand and leads them to and seats them in a place to which they are to be transferred. These and other objects, features, and advantages of the non-limiting exemplary embodiment(s) are provided by a seat unit wrapping around the buttocks as a cushion, pants-type garment or supporter so that a care-receiver can wear it at all times without discomfort. The seat unit has pulling band for pulling up at both sides by a caregiver, and serves as a pelvis support wrapped around and supporting from the low back to the thighs of the care-receiver during the pulling-up motion, and thereby safely supporting the lower back of the care-receiver during transfer and standing assistance.

The pulling bands on both sides of the said seat unit mentioned above should be attached in such a way that the grasping point of the pulling band for the care-receiver is lower than the solar plexus in a seated state. This arrangement is necessary for lifting the buttocks of a care-receiver by pulling the care-receiver's buttocks diagonally forward.

One method of connecting the said pulling bands connected to both sides is to connect them at either side of the hip, and another method is to connect the one edge of the pulling bands to be attached respectively to both sides around the great trochanter or hip area near the ilium of the care-receiver, and fix the other edge to around the center of the femur when standing. By these arrangements, the center of gravity of the care-receiver is effectively transferred.

Similarly, adequate strength to support the care-receiver's bodyweight must be maintained by tightly connecting the pulling bands and strong fabric wrapping the buttocks.

The embodiment of this invention also includes a knee-fixing unit, which is integrated with the pulling band and the pelvis support, when in use. This prevents care-receivers from crouching forward from bending at the knees and also maintains the standing position of the care receiver during the pulling-up action while serving as a fulcrum. This can be made with a fabric or a band wrapped around the knees, and can also consist of a hard member made of wood, metal, rubber, or other material not prone to shape deformation and a soft member provided with cushioning that makes contact with the lower leg area of a care-receiver.

The invention according to claim 1 provides a configuration that includes: a pelvis support that is a fabric strong enough to support the weight of a care-receiver and that is a fabric or sheet or mesh wrapped around at least the buttocks or the pelvis or both the pelvis and buttocks or a section extending from the pelvis to the thighs to provide support; pulling bands that are connected firmly to the pelvis support that is used by a caregiver to pull up the seated care-receiver and that are each formed with two connecting ends that are attached to the hip so that they are positioned above and below the greater trochanter when the care-receiver is standing and in front of and behind the greater trochanter when the care-receiver is seated, as shown in FIG. 3; and a knee-fixing unit wrapped around and supporting either the knee area or at least the front and sides of the lower leg area from knee to ankle in order to restrict free movement of the knees of the care-receiver. With this configuration, it is possible for the caregiver to provide standing assistance to a care receiver any time by pulling-up motion.

In the invention according to claim 2, the knee-fixing unit is formed as a band or a fabric that is wrapped around a section from the knees to the shins or around the lower leg area. When assistance is being provided, the knee-fixing unit can be connected to the pulling bands and the connecting belts as shown in FIG. 1 or 4 but at other times the knee-fixing unit can be easily unwrapped or removed. As a result, the knee-fixing unit can prevent a care-receiver who cannot maintain a standing position from bending at the knees and squatting down while serving as a fulcrum when providing standing assistance. Since it is removable, the knee-fixing unit does not usually restrict the legs but, when in use, immediately serves as a transfer/standing aid. By using a fabric or a band that is both strong and flexible for the knee-fixing unit, it is possible to provide stability. By keeping the knee-fixing unit wide, concentrated pressure is prevented for the care-receiver and the caregiver.

In the invention according to claim 3, the pelvis support is formed as at least part of a cushion or pants seat, thus allowing it to be worn by the care-receiver even when assistance is not being provided. As a result, the need to attach the pelvis support and bands each time assistance is to be provided can be eliminated and the function of invention can be fully embodied by attaching just the knee-fixing unit when assistance is to be provided.

In the invention according to claim 4, the pulling bands are attached to the left and right sides of the hip or from the left and right sides of the ilium to the sides of the femurs, and the length of the pulling bands can be restricted or adjusted so that the grasping points do not go above the solar plexus during usage. As a result, pulling-up force can be applied efficiently, and force is not applied in a way that puts pressure on the crotch of the care-receiver. If the pulling bands are too long, it can be difficult to efficiently transfer weight when a caregiver grasps the pulling bands and applies his or her weight backward. Thus, the grasping points should be positioned below the solar plexus.

There has thus been outlined, rather broadly, the more important features of non-limiting exemplary embodiment(s) of the present disclosure so that the following detailed description may be better understood, and that the present contribution to the relevant art(s) may be better appreciated. There are additional features of the non-limiting exemplary embodiment(s) of the present disclosure that will be described hereinafter and which will form the subject matter of the claims appended hereto.

BRIEF DESCRIPTION OF THE NON-LIMITING EXEMPLARY DRAWINGS

The novel features believed to be characteristic of non-limiting exemplary embodiment(s) of the present disclosure are set forth with particularity in the appended claims. The non-limiting exemplary embodiment(s) of the present disclosure itself, however, both as to its organization and method of operation, together with further objects and advantages thereof, may best be understood by reference to the following description taken in connection with the accompanying drawings in which:

Figure 1:
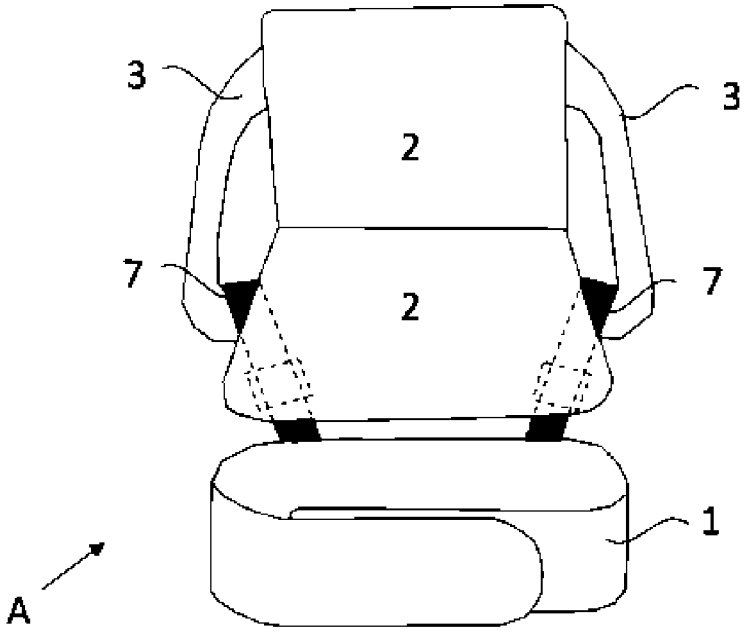
FIG. 1 is a front view illustrating a cushion-type device to provide assistance in transferring, standing, and the like in the embodiment of the present invention.

Those skilled in the art will appreciate that the figures are not intended to be drawn to any particular scale; nor are the figures intended to illustrate every non-limiting exemplary embodiment(s) of the present disclosure. The present disclosure is not limited to any particular non-limiting exemplary embodiment(s) depicted in the figures nor the shapes, relative sizes or proportions shown in the figures.

DETAILED DESCRIPTION OF NON-LIMITING EXEMPLARY EMBODIMENT(S) OF THE PRESENT DISCLOSURE

The present disclosure will now be described more fully hereinafter with reference to the accompanying drawings, in which non-limiting exemplary embodiment(s) of the present disclosure is shown. The present disclosure may, however, be embodied in many different forms and should not be construed as limited to the non-limiting exemplary embodiment(s) set forth herein. Rather, such non-limiting exemplary embodiment(s) are provided so that this application will be thorough and complete, and will fully convey the true spirit and scope of the present disclosure to those skilled in the relevant art(s). Like numbers refer to like elements throughout the figures.

The illustrations of the non-limiting exemplary embodiment(s) described herein are intended to provide a general understanding of the structure of the present disclosure. The illustrations are not intended to serve as a complete description of all of the elements and features of the structures, systems and/or methods described herein. Other non-limiting exemplary embodiment(s) may be apparent to those of ordinary skill in the relevant art(s) upon reviewing the disclosure. Other non-limiting exemplary embodiment(s) may be utilized and derived from the disclosure such that structural, logical substitutions and changes may be made without departing from the true spirit and scope of the present disclosure. Additionally, the illustrations are merely representational are to be regarded as illustrative rather than restrictive.

One or more embodiment(s) of the disclosure may be referred to herein, individually and/or collectively, by the term "non-limiting exemplary embodiment(s)" merely for convenience and without intending to voluntarily limit the true spirit and scope of this application to any particular non-limiting exemplary embodiment(s) or inventive concept. Moreover, although specific embodiment(s) have been illustrated and described herein, it should be appreciated that any subsequent arrangement designed to achieve the same or similar purpose may be substituted for the specific embodiment(s) shown. This disclosure is intended to cover any and all subsequent adaptations or variations of other embodiment(s). Combinations of the above embodiment(s), and other embodiment(s) not specifically described herein, will be apparent to those of skill in the relevant art(s) upon reviewing the description.

References in the specification to "one embodiment(s)", "an embodiment(s)", "a preferred embodiment(s)", "an alternative embodiment(s)" and similar phrases mean that a particular feature, structure, or characteristic described in connection with the embodiment(s) is included in at least an embodiment(s) of the non-limiting exemplary embodiment(s). The appearances of the phrase "non-limiting exemplary embodiment" in various places in the specification are not necessarily all meant to refer to the same embodiment(s).

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiment(s) and are not necessarily intended to be construed as limiting.

If used herein, "about" means approximately or nearly and in the context of a numerical value or range set forth means±15% of the numerical.

If used herein, "substantially" means largely if not wholly that which is specified but so close that the difference is insignificant.

The non-limiting exemplary embodiment(s) is/are referred to generally in FIGS. 1-7. Now, an explanation will be given of a device to provide assistance in transferring, standing, and the like with reference to figures.

As shown in FIG. 1, a device to provide assistance in transferring, standing, and the like A includes a knee-fixing unit 1, a cushion 2 as the knee-fixing unit 1 and a pelvis support, and pulling bands 3 connected to the cushion.

Figure 2:
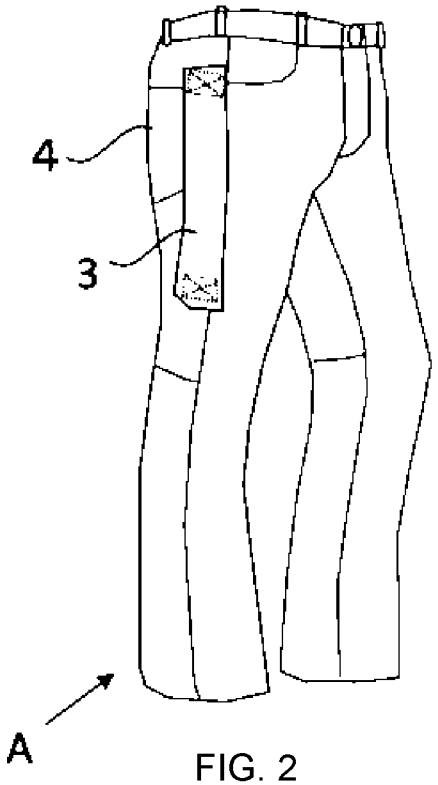
FIG. 2 is a perspective view illustrating the condition before attaching the knee-fixing unit in a pair-of-pants-type device to provide assistance in transferring, standing, and the like in the embodiment of the present invention.

The part of the pulling bands and pelvis support shown in FIG. 1 can be formed by a pair-of-pants-type part 4 and pulling bands 3 as shown in FIG. 2. On the other hand, by using a fabric or a belt connecting the belly area and the back side as in a pair-of-pants-type, the cushion-type can achieve better adhesion of the aid to the care-receiver, thus enhancing stability.

Figure 3:
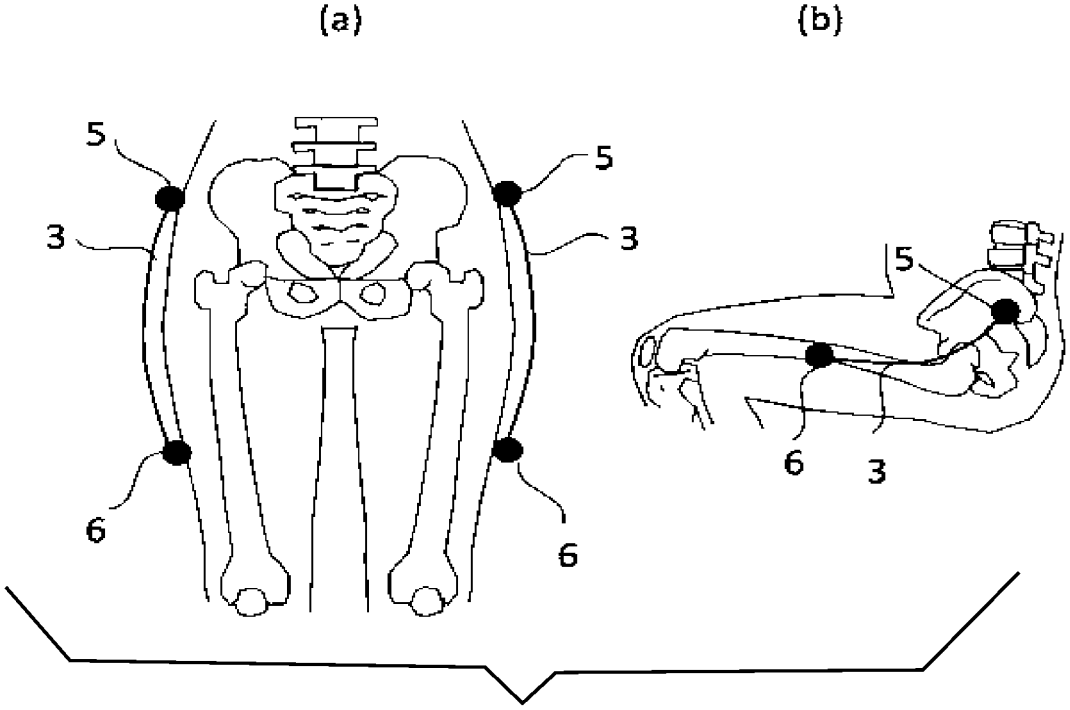
FIG. 3 illustrates the relationship between the pulling band attachment location and the skeleton in the embodiment of the present invention.

In both cases shown in FIGS. 1 and 2, the ends of each pulling band 3 on either side of the pelvis region are securely connected to a cushion-type part 2 or a pair-of-pants-type part 4. As shown in FIG. 3, the upper end 5 is attached to a position near the ilium above the femoral neck and the lower end 6 is attached near the center of the femur. The lower end 6 may be connected near the femoral neck.

If the grasping point of each pulling band 3 is too high, it becomes difficult for a caregiver to apply his or her weight backward to pull up a care-receiver. Therefore, it should be designed in such a way that the grasping points of each pulling band is at a position lower than the solar plexus of the care-receiver 8, for example, at an appropriate position near the femoral neck as shown FIG. 3, by which it becomes possible for a caregiver to apply his or her weight backward to pull up a care-receiver while grasping the pulling band of the stand aid A.

As described above, a cushion or a pair of pants can be worn at all times, thus saving time and effort for suiting-up.

Figure 4:
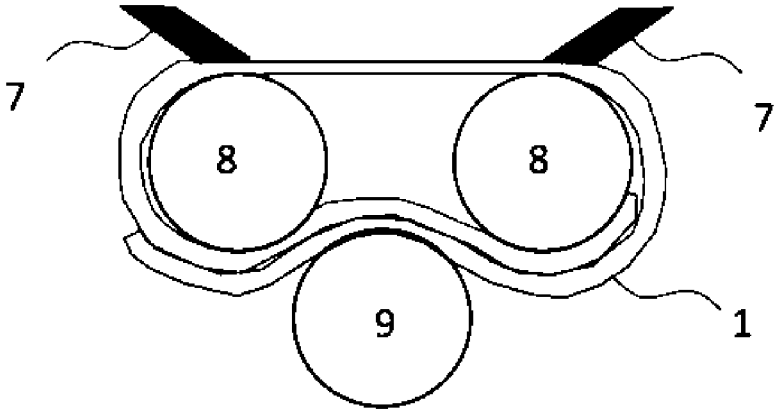
FIG. 4 is a side view illustrating a pair-of-pants-type device to provide assistance in transferring, standing, and the like consisting of knee-fixing unit, pulling belts, pelvis support, and seat unit.

FIG. 4 illustrates the knee-fixing unit having been wrapped around the legs in a seated state. The knee-fixing unit is combined and integrated with the pulling belts of the pelvis support by a connecting belt 7.

Figure 5:
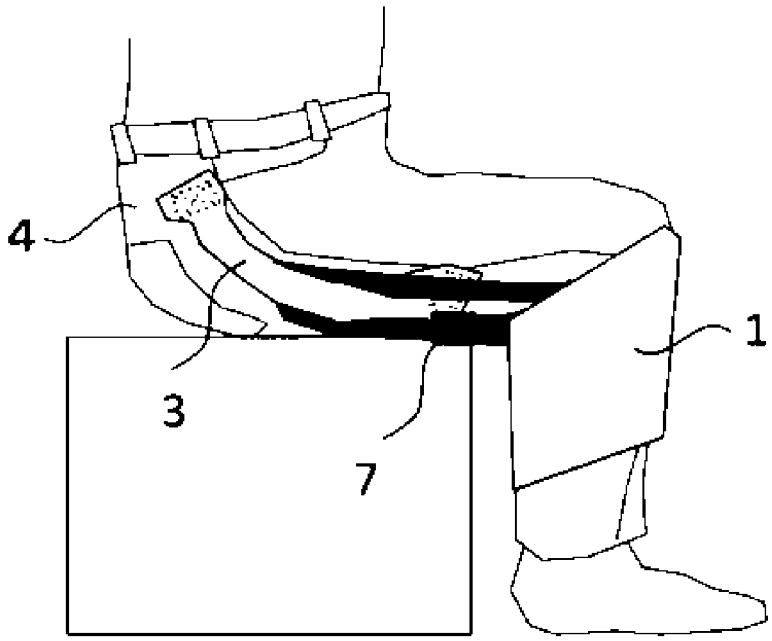
FIG. 5 is a cross-sectional view of the lower leg area when using knee-fixing unit in the embodiment of the present invention.

FIG. 5 is a cross-sectional view of the legs of a caregiver and a care receiver when the knee-fixing unit 1 is wrapped around the lower leg area 8 of the care receiver. The knees are fixed by pushing the caregiver's knee 9 against the knee-fixing unit.

Figure 6:
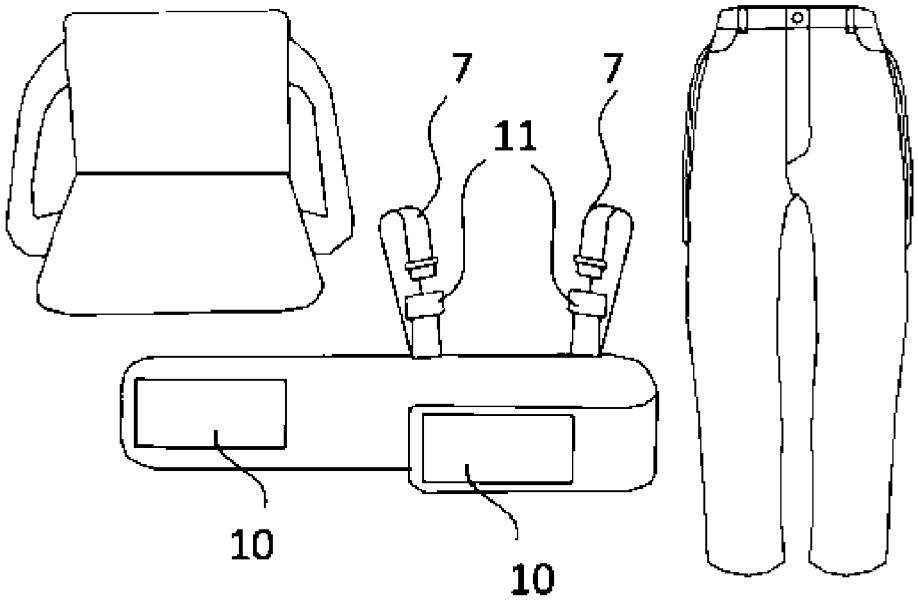
FIG. 6 is a front view of a cushion-type pelvis support, a pair-of-pants-type pelvis support, and a separated knee-fixing unit in the embodiment of the present invention.

FIG. 6 illustrates when the knee-fixing unit has been removed. Easy installation/detachment of the knee-fixing unit enables fixing of knees only during assistance and is not restrictive in other cases.

Hereinafter, detailed requirement components of the stand aid seat of the present invention are disclosed.

As shown in FIGS. 1 and 2, a cushion-type or pair-of-pants-type pelvis support has a shape to be used or worn on a daily basis as a cushion or clothing. The pelvis supports are composed of durable material such as denim and canvas, making it possible to support the bodyweight of a care-receiver safely in transfer/stand assistance.

The shape and structure of the cushion-type or pair-of-pants-type pelvis support can be selected as appropriate. For example, it is possible to increase the thickness of the cushion for prevention of decubitus ulcers, or to introduce a mesh fabric in parts for breathability. The present invention can be applied to shower assistance etc. by utilizing water-proof or water repellent treated materials.

The pulling bands have handles which are grasped by the caregiver when assisting a care-receiver to stand, and are formed by strong band made of denim, canvas, nylon or other synthetic fiber, resin, or leather, etc. that would not be easily torn during pulling-up motion.

The pair-of-pants-type part and the pulling bands must be connected tightly to each other for supporting the weight of the care-receiver with strong stitching with strong yarn.

It is possible to appropriately select the shape and material of the pulling bands, but it is preferable that the position grasped by a caregiver during stand assistance is designed near the femoral neck area lower than the solar plexus of the care-receiver.

The knee-fixing unit suppresses the bending of a care-receiver's knees by wrapping the knees as shown in FIG. 4. In order to attach/detach the knee-fixing unit easily, connecting using a hook-and-loop fastener 10 as shown in FIG. 6 is preferable. Buckles 11 can be used to facilitate attaching/detaching of the pulling belts and pelvis support to/from the knee-fixing unit as shown in FIG. 6. Of course, it is possible to use various methods such as zippers, buttons, or carabiners for the attachment/detachment.

Also, in FIGS. 1 and 4, the knee-fixing unit and the pulling belts are connected, but the present invention is not limited to this connecting method. It is also possible to connect the pelvis support and the knee-fixing unit not at the pulling belts, but by using different structures such as connector rings or belt loops provided on the pelvis support or buckles attached on the pelvis support.

The pulling band length with appropriate grasping point as described above enables, as shown in FIG. 7, natural motion of a caregiver 12 in pulling up a care-receiver by shifting the center of his/her gravity backward without bending too far forward or backward. Attaching pulling bands at the side of the thigh area as in the present invention is effective for effectively shifting the center of gravity. In an inventor's consideration, attaching handles at the buttocks is not as effective for transfer of weight as attaching them to the sides.

Use examples for a stand aid in the first embodiment of the present invention described above are explained below.

Figure 7:
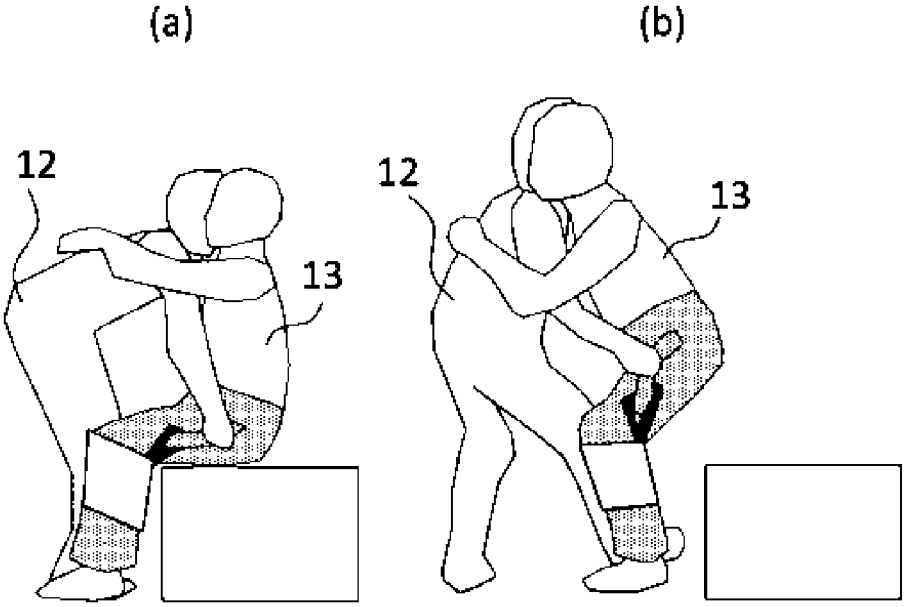
FIG. 7 is a side view illustrating the use of the device to provide assistance in transferring, standing, and the like of the present invention.

First, as shown in FIG. 7 (*a*), a caregiver 12, in front of a care-receiver 13 wearing a stand aid of the present invention, grasps the left and right pulling bands with outstretched arms. Then, as shown in the cross-sectional view of FIG. 5, it is preferable for the caregiver's pivot foot to be pressed against the part wrapped around the care-receiver's lower leg area and the care-receiver's arm to be brought around the back of the caregiver.

Then the caregiver draws back the foot away from the care-receiver while keeping arms appropriately outstretched and shifts the center of gravity backward with the pivot foot as the fulcrum as shown in FIG. 7 (*b*). When changing direction, the caregiver further turns on the pivot foot, and guides the care-receiver to a seated state.

During standing and seating, the caregiver assists the care-receiver by principle of leverage, where the grasping point of pulling band is the point of load, the center of gravity moved by the caregiver is the point of effort, and the knee-fixing unit is the fulcrum. By this transition of gravity, a care-receiver can be naturally pulled up to stand and guided to a seated state, reducing the load on the arms and lower back of the caregiver.

Further, compared to conventional stand aids, the stand aid of the present invention does not require troublesome procedures of suiting-up the care-receiver because of being in daily use, except for the knee-fixing unit, thereby improving work efficiency, and enables steady standing since the contact area to a care-receiver is large. The present invention can be applied to slippery shower assistance etc. by utilizing waterproof or water repellent treated materials.

It should be understood that the foregoing relates only to illustrative embodiments of the present invention, and that restructuring, variation, and modification is possible without departing from the scope and spirit of the invention as defined by the claims.

A Main body of a device to provide assistance in transferring, standing, and the like is disclosed in the figures with the following reference numbers.

1 Knee-fixing unit
2 Cushion-type pelvis support
3 Pulling band
4 Pair-of-pants-type pelvis support
5 Pulling band upper end attachment position
6 Pulling band lower end attachment position
7 Connecting belt
8 Cross-sectional view of lower leg area of a care-receiver
9 Cross sectional view of lower leg area of a care-receiver
10 Hook-and-loop fastener
11 Buckle
12 Caregiver
13 Care-receiver While non-limiting exemplary embodiment(s) has/have been described with respect to certain specific embodiment(s), it will be appreciated that many modifications and changes may be made by those of ordinary skill in the relevant art(s) without departing from the true spirit and scope of the present disclosure. It is intended, therefore, by the appended claims to cover all such modifications and changes that fall within the true spirit and scope of the present disclosure. In particular, with respect to the above description, it is to be realized that the optimum dimensional relationships for the parts of the non-limiting exemplary embodiment(s) may include variations in size, materials, shape, form, function and manner of operation.

The Abstract of the Disclosure is provided to comply with 37 C.F.R. § 1.72(b) and is submitted with the understanding that it will not be used to interpret or limit the scope or meaning of the claims. In addition, in the above Detailed Description, various features may have been grouped together or described in a single embodiment for the purpose of streamlining the disclosure. This disclosure is not to be interpreted as reflecting an intention that the claimed embodiment(s) require more features than are expressly recited in each claim. Rather, as the following claims reflect, inventive subject matter may be directed to less than all of the features of any of the disclosed non-limiting exemplary embodiment(s). Thus, the following claims are incorporated into the Detailed Description, with each claim standing on its own as defining separately claimed subject matter.

The above disclosed subject matter is to be considered illustrative, and not restrictive, and the appended claims are intended to cover all such modifications, enhancements, and other embodiment(s) which fall within the true spirit and scope of the present disclosure. Thus, to the maximum extent allowed by law, the scope of the present disclosure is to be determined by the broadest permissible interpretation of the following claims and their equivalents, and shall not be restricted or limited by the above detailed description.

What is claimed as new and what is desired to secure by Letters Patent of the United States is:

1. A device to provide assistance in transferring, standing, and the like comprising:

a knee-fixing unit wrapped around and supporting either the knee area or at least the front and sides of the lower leg area from knee to ankle of a care receiver;

a pelvis support formed from fabric or sheet or mesh that is wrapped around at least the buttocks or a section from the pelvis to thighs of said care receiver in a manner that provides curved planar support and prevents slippage from said pelvis support from slipping off; and left and right pulling bands, each band being formed with two connecting ends that are attached to the side of a thigh section and the side of a hip section of said pelvis support respectively so that said bands are configured to be positioned above and below the care receiver's greater trochanter when said care receiver is being pulled up during transfer/standing assistance and are configured to be positioned in front of and behind the care receiver's greater trochanter when said care receiver is seated;

wherein, when assistance is being provided, connecting belts extended from said knee-fixing unit are passed through a loop formed by said pelvis support and said pulling bands to the left and right of said pelvis support and are reconnected to said knee fixing section or to said connecting belts themselves, and thus said connecting belts form left and right loops that connect said knee-fixing unit, said pelvis support, and said pulling bands.

2. A device to provide assistance in transferring, standing, and the like according to claim 1, wherein said knee-fixing unit is formed as a band or a fabric that is configured to be wrapped around a section from the care receiver's knees to the care receiver's shins or around the care receiver's lower leg area and configured to be easily unwrapped when assistance is not being provided; and said knee-fixing unit configured to be removed from said pulling bands and said pelvis support by detaching said connecting belt from said loop formed by said pulling bands and said pelvis support.

3. A device to provide assistance in transferring, standing, and the like according to claim 1, wherein said pelvis support is formed as part of a pair of pants or a cushion with said pants or cushion being permanently integrated with said pulling bands, so that pulling belts are exposed at the sides when in a seated state and the attachment positions of said pulling belts in the seated state are such that attachment is configured to be higher toward the care receiver's ilium and lower toward the care receiver's thigh, thus making it easy for said caregiver facing said care receiver to pull up said care receiver diagonally forward.

4. A device to provide assistance in transferring, standing, and the like according to claim 2, wherein a length of said pulling bands can be restricted or adjusted so that when providing pulling up assistance, grasping points of said pulling bands are configured to not go above the care receiver's solar plexus.

5. A device to provide assistance in transferring, standing, and the like according to claim 3, wherein a length of said pulling bands can be restricted or adjusted so that when providing pulling up assistance, grasping points of said pulling bands are configured to not go above the care receiver's solar plexus.

6. A device to provide assistance in transferring, standing, and the like according to claim 2, wherein said pelvis support is formed as part of a pair of pants or a cushion with said pants or cushion being permanently integrated with said pulling bands, so that pulling belts are exposed at the sides when in a seated state and the attachment positions of said pulling belts in the seated state are such that attachment is configured to be higher toward the care receiver's ilium and lower toward the care receiver's thigh, thus making it easy for said caregiver facing said care receiver to pull up said care receiver diagonally forward.

* * * * *